US006779915B2

(12) United States Patent
Foster, Jr.

(10) Patent No.: US 6,779,915 B2
(45) Date of Patent: Aug. 24, 2004

(54) HOLDER FOR 5 GALLON BUCKET DURING MIXING

(76) Inventor: Charles D. Foster, Jr., 364 Mashburn Branch, Franklin, NC (US) 28734

( * ) Notice: Subject to any disclaimer, the term of this patent is extended or adjusted under 35 U.S.C. 154(b) by 123 days.

(21) Appl. No.: 10/158,867

(22) Filed: Jun. 3, 2002

(65) Prior Publication Data

US 2003/0223306 A1 Dec. 4, 2003

(51) Int. Cl.[7] ..... B01F 15/00

(52) U.S. Cl. ..... 366/129; 366/349; 366/605; 248/146

(58) Field of Search ..... 366/129, 130, 366/197, 349, 605; 248/146, 678, 163.1, 176.1, 346.01, 346.03; 108/25, 26, 55.3; 211/71.01, 74; 15/268

(56) References Cited

U.S. PATENT DOCUMENTS

| | | | | | |
|---|---|---|---|---|---|
| 1,846,405 | A | | 2/1932 | Stroud | |
| 1,877,217 | A | * | 9/1932 | Sidney | 312/289 |
| 2,508,802 | A | * | 5/1950 | Stanley | 108/28 |
| 2,897,974 | A | | 8/1959 | Cook | |
| 2,963,256 | A | | 12/1960 | Borah | |
| 3,105,665 | A | * | 10/1963 | Charles | 248/101 |
| 3,201,075 | A | | 8/1965 | Sievers | |
| 3,301,512 | A | * | 1/1967 | Nyberg | 248/524 |
| 3,380,402 | A | * | 4/1968 | Gordon | 108/25 |
| D212,413 | S | | 10/1968 | Lacoste | |
| 4,311,238 | A | | 1/1982 | Smith | |
| 4,877,208 | A | * | 10/1989 | Kennard, Jr. | 248/146 |
| D328,375 | S | | 7/1992 | Levine | |
| 5,150,804 | A | | 9/1992 | Blancher et al. | |
| D351,787 | S | | 10/1994 | Hansen | |
| D351,792 | S | | 10/1994 | Morris, Sr. | |
| D362,180 | S | | 9/1995 | Haines | |
| 5,572,934 | A | * | 11/1996 | Aldridge et al. | 108/25 |
| 5,634,617 | A | | 6/1997 | Morris | |
| 5,692,830 | A | | 12/1997 | Costanzo | |
| 5,759,275 | A | * | 6/1998 | Shostak | 118/504 |
| 5,778,800 | A | * | 7/1998 | Liang | 108/50.11 |
| 6,161,954 | A | | 12/2000 | DeWall | |
| 6,464,184 | B1 | * | 10/2002 | Lytle | 248/126 |
| 2003/0016586 | A1 | * | 1/2003 | Williams | 366/349 |
| 2003/0146352 | A1 | * | 8/2003 | Zagorsky | 248/146 |
| 2003/0189873 | A1 | * | 10/2003 | Moore | 366/349 |

FOREIGN PATENT DOCUMENTS

| | | |
|---|---|---|
| CA | 1313769 | 2/1993 |

* cited by examiner

*Primary Examiner*—Charles E. Cooley
(74) *Attorney, Agent, or Firm*—Richard C. Litman

(57) ABSTRACT

A five gallon bucket holder platform for mixing a variety of compounds and/or painting mixtures is a substantially rectangular box structure having a top, a bottom and four sides made perpendicular to the bottom and top surfaces. The top surface portion has disposed therein a substantially central circular aperture for frictionally retaining a bucket containing material to be mixed therein. In operation the user mounts the platform and inserts a bucket with mixing material within the aperture for subsequent manual or motor-tool driven mixing.

4 Claims, 3 Drawing Sheets

HOLDER FOR 5 GALLON BUCKET DURING MIXING

BACKGROUND OF THE INVENTION

1. Field of the Invention

The present invention relates generally to holders. More specifically, the invention is a five gallon bucket holder platform for mixing a variety of compounds or paint mixtures.

2. Description of the Related Art

Mixing devices of various sorts have been devised for supporting cups, bowls and other containers such as drink cups, etc. Conventional support devices or platforms for mixed drinks or the like are described in the U.S. patents issued to Cook U.S. Pat. No. (2,897,974), Borah U.S. Pat. No. (2,963,256) and U.S. Pat. No. 3,201,075). U.S. Pat. No. 5,634,617 issued to Morris discloses a mixing bowl supporting assembly. The primary emphasis of these article retainers is the particular shape and contour of the holder for retaining various shaped cups, containers, etc.

More complex mixing devices have the problems of using special spring loaded fixtures or lift mechanisms and motor driven mixing rods which often requires replacement or costly repairs. This particular features also require being mounted to the platform frame via mechanically fastened retainer plates or the like for respectively mixing and securing containers to the platform. U.S. Pat. No. 1,846,405 issued to Stroud discloses a drink mixer of this kind which automatically and forcibly raises/lowers a drink container while the same is being mixed.

U.S. Pat. No. 3,761,026 issued to Rohmer discloses a mixing grinding apparatus comprising a bucket like container having a centrally positioned, elongate, spindle-rod extending from the container base axially into the container cavity, and having a cutting blade affixed to an elongated tubular shaft. A top retainer plate rests within a top portion of the bucket via a first and second hook member secured at first and second peripheral edge portions of the plate for attachment to the rim of the bucket are opposing ends. Each hook is secured by a respective clamp.

U.S. Pat. No. 4,311,238 issued to Smith discloses a container enclosure having a plurality of U-shaped stacking lugs which mating attached to a bottom rim with conformation to provide a stackable container or bucket package without twisting. A similar container or pail is described in the U.S. patent issued to Blancher et al. U.S. Pat. No. (5,150,804) which is rotationally resistant and contains cementations or viscous material.

U.S. Pat. No. 4,877,208 issued to Kenard, Jr. discloses a support for a mixer bucket which includes a raised platform having a recess shape to accommodate the base of a mixer bucket to prevent twisting. The platform is shaped having a rectangular first end and a circular opposing and tapered second end. The circular portion tapers or narrows in width and has a recess for accommodating the base of a bucket. A series of support ridges extend radially from the base of the platform to provide structural reinforcement to the platform.

U.S. Pat. No. 5,692,830 issued to Costanzo discloses a rotating mixer tray for mixing drinks. The tray utilizes a tumbler-type container attached to a base and a rotatable whisk. The whisk is turned by rotatable gears, one of which is attached to a motor and one of which is attached to the base of the container. When the whisk rotates, its speed and shape create a tornado or whirlpool-like effect form mixing.

The motor for the whisk is house within a rectangular motor housing unit which fits into the tray for serving.

U.S. Pat. No. 6,161,954 discloses a mud mixing apparatus which mixes powdered or premixed drywall joint compound and water to form a slurry for subsequent pumping. The container with slurry includes a portable rolling platform or dolly and pump system that rests within the container. On the upper lip portion of the container rests a mixing driver assembly for engaging the mixing elements as the driver rotates.

Canadian Patent No. 1,313,769 granted to Kleiner discloses a combination cup and plate holder in which a user can carry simultaneously with a single hand. The cup and plate holder comprises a flat, tongue-shaped platform to support a plate and a cylindrical retaining collar in which to receive a cup or glass. The platform is connected to a rotatable support block, so that the platform is rotatable therewith.

The following U.S. Design patents issued to Locoste (Des. Pat. No. 212,413), Levine (Des. Pat. No. 328,375), Hanson (Des. Pat. No. 351,787), Morris, Sr. (Des. Pat. No. 351,792) and Haines (Des. Pat. No. 362,180) disclose ornamental features of various buckets and bucket platforms, respectively considered to be of general relevance to the five gallon bucket holder and platform as herein described.

None of the above inventions and patents, taken either singularly or in combination, is seen to describe the instant invention as claimed. Thus, a five gallon bucket holder and platform for mixing various compounds and/or paint mixtures solving the aforementioned problems without the requirement of special moveable parts or mechanisms is desired.

SUMMARY OF THE INVENTION

The five gallon bucket holder/platform for mixing a variety of compounds and/or painting mixtures is a substantially rectangular box structure having a top, a bottom and four sides made perpendicular to the bottom and top surfaces. The top surface portion has disposed therein a substantially central circular aperture for frictionally retaining a bucket containing material to be mixed therein. In operation the user mounts the platform and inserts a bucket with mixing material within the aperture for subsequent manual or motor-tool driven mixing. The bucket holder platform is preferably 21 inches long by 16 inches wide and 4.5 inches high. Each of the two ends of the top surface portion extend 2 inches towards the middle, at which point the top descends toward the bottom along a diagonal or 45 degrees at which point the holder's height is about 2.5 inches. The circular aperture in the top is preferably 10 and ⅝ inches in diameter.

Accordingly, it is a principal object of the invention to provide a five gallon bucket holder and platform for mixing a variety of mixing elements.

It is another object of the invention to provide a five gallon bucket holder and platform which light-weight.

It is a further object of the invention to provide a five gallon bucket holder and platform which structurally rigid and impervious to cyclical material fatigue.

Still another object of the invention is to provide a five gallon bucket holder and platform which made via an injection molded process.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 2:
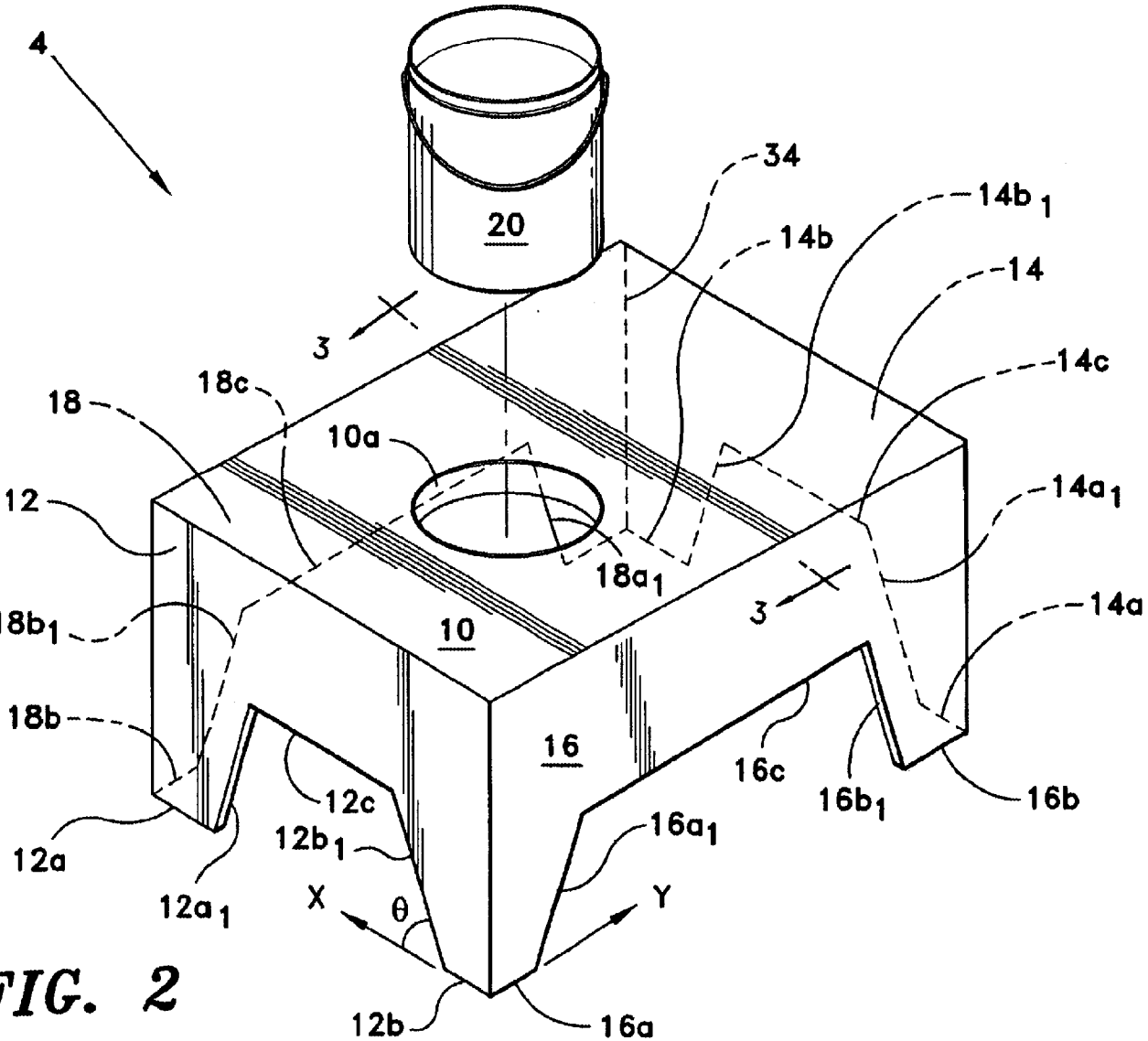
FIG. 2 is an exploded perspective view of the bucket holder platform according to the invention.
Figure 3:
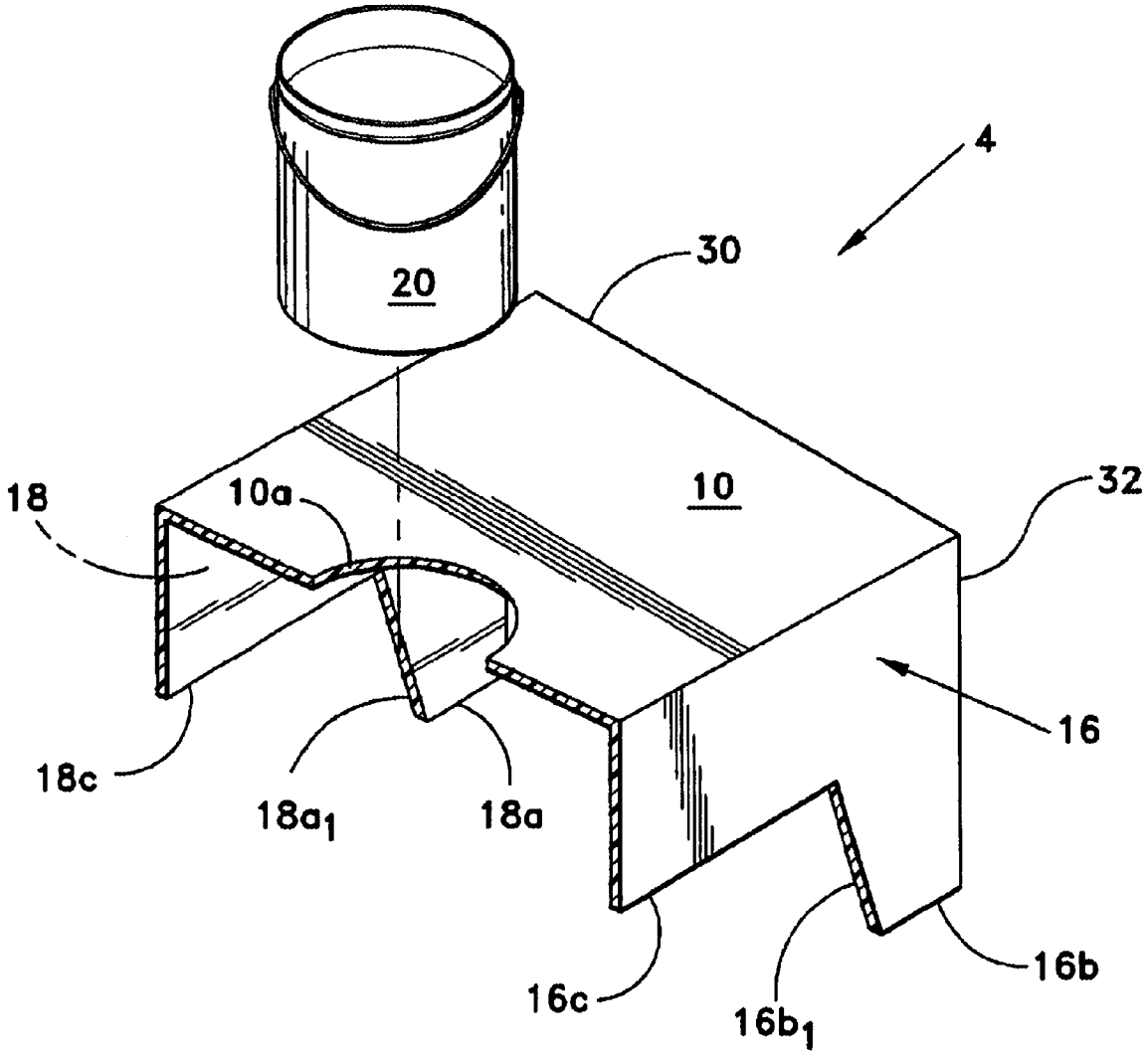
FIG. 3 is a sectional perspective of the bucket holder platform as shown in FIG. 2, taken along line 3—3.

The present invention is directed to a combination mixing platform and holder system for five gallon buckets. The preferred embodiment of the invention is depicted in FIGS. 1–3, and is generally referenced by numeral 4.

Figure 1:
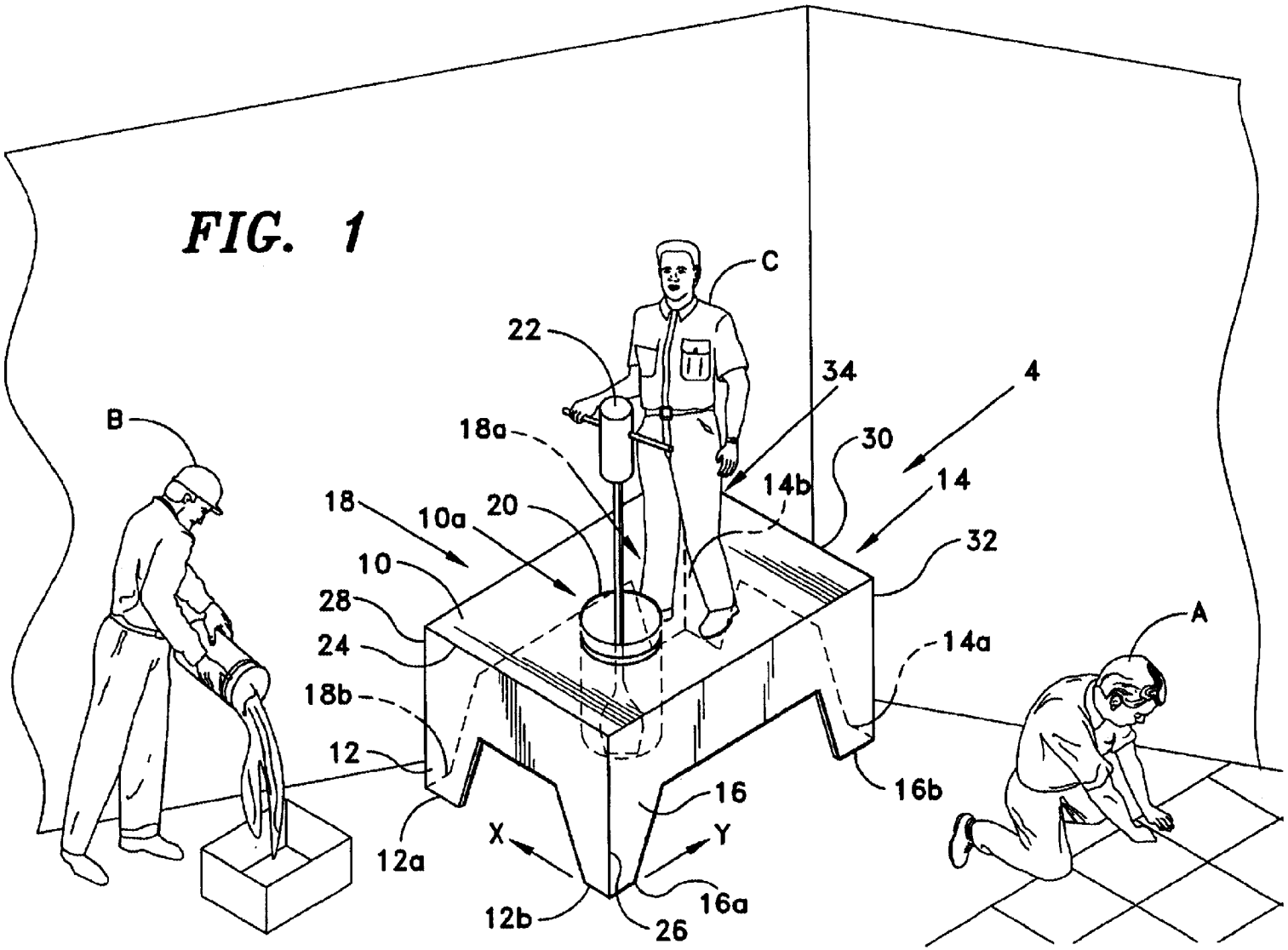
FIG. 1 is an environmental, perspective view of a 5 gallon bucket holder platform for mixing according to the present invention.

As best seen in FIG. 1, the combination mixing platform and bucket holder system 4 is shown in an environmental perspective illustrating multiple use of the platform for numerous applications (eg. laying tile, drywall finishing, general mixing, painting, etc.) by journeymen A, B and C, respectively. Accordingly, the system 4 comprises a platform formed by a top surface portion 10, a first and second opposing side surface portion 12,14 which are configured and dimensioned to define the width of the platform. The dimensions of the platform system 4 as shown, have been exaggerated for illustrative purposes only. It would be obvious to one having ordinary skill in the relevant art to dimension and configure the combination platform and holder system 4 as a mere matter of design choice to fulfill an intended need.

In this regard, the length dimension of the system 4 is defined with respect to third and fourth opposing side surface portions 16,18. The top surface portion 10 further comprises at least one substantially central aperture 10*a* having a predetermined depth and area for frictionally retaining a five gallon bucket 20 for manual and or motor-tool 22 driven mixing. For load support, the first, second, third and fourth side portions 12,14,16,18 include respective first and second leg portions (12*a*,12*b*), (14*a*,14*b*), (16*a*,16*b*) and (18*a*,18*b*) for supporting the platform and holder system 4 to sustain a predetermined load capacity and to resist buckling from cyclical loads or repeated use. For ease of use and deployment the system 4 is preferably made of a high strength plastic or composite plastic material.

As a single integrated support structure 4, the first side surface portion 12 is formed contiguous with a top surface portion or first edge 24 and a second and third edge portion 26 and 28, respectively of the respective third and fourth surface side portions 16,18. The second side surface portion 14 is formed contiguous with a top surface portion along a second edge 30 and a fourth and fifth edge portion 32,34 of the third and fourth surface side portions 16,18. Similar contiguous attachments are made for the third and fourth side surface portions with the respect to a respective edge portion of the top surface portion 10.

As a structural reinforcement measure, at least one of the leg portions (16*a*,16*b*) and (18*a*,18*b*) of the respective third and fourth side surface portions 16,18 is made contiguous and orthogonal with at least one leg portion (12*a*,12*b*) and (14*a*,14*b*), of the first and second side portions 12,14 to form a respective single leg portion having support in a single plane, but formed in orthogonal relationship and in two directions X and Y, respectively.

As diagrammatically illustrated in FIG. 2, the holder platform 4 is shown more clearly in an exploded perspective, wherein the respective leg portions (12*a*,12*b*), (14*a*,14*b*), (16*a*,16*b*) and (18*a*,18*b*) of each respective side portion 12,14,16 and 18 has a respective first and second diagonal edge disposed at an angle of 45 degrees ($12a_1$,$12b_1$), ($14a_1$,$14b_1$), ($16a_1$,$16b_1$) and ($18a_1$,$18b_1$) extending from the base of the respective leg portions (12*a*,12*b*), (14*a*,14*b*), (16*a*,16*b*) and (18*a*,18*b*) to a predetermined height, terminating along a respective horizontal edge portion 12*c*, 14*c*, 16*c* and 18*c*. The height of each respective diagonal edge portions ($12a_1$,$12b_1$), ($14a_1$,$14b_1$), ($16a_1$,$16b_1$) and ($18a_1$,$18b_1$) is determined to minimize buckling due to certain loads and/or cyclical loadings.

An exploded sectional perspective of the system 4 is diagrammatically illustrated in FIG. 3 to depict a bucket 20 insertion area 20*a* of a different depth or thickness. In addition the platform and holder 4 is also shown with a specified thickness to illustrate a material strength characteristic have a design specific structural rigidity. In this regard, the combination platform and holder 4 is designed to hold a five gallon plastic mixing bucket 20 in place during mixing applications. The unique feature is the frictional fit of the bucket 20 within the top portion 10 of the platform system 4 which prevents unwanted vibrations and movement of the bucket 20 during mixing.

These particular features virtually eradicates the source of user aggravation of moving or spinning buckets 20 normally experienced with conventional systems when mixing heavy and/or stiff materials, such as drywall compounds, tile setters, thin-set or other materials, like synthetic materials used for stucco applications, etc. The system 4 is preferably made from an injection molded process involving a heavy and durable plastic or composite plastic material. The major focus is directed to the simple structure of the system 4 without requiring special fasteners or complex mechanisms for deployment and use. Special wedge elements can be use to provide a greater degree of friction between the bucket and platform during a mixing application.

It is to be understood that the present invention is not limited to the embodiment described above, but encompasses any and all embodiments within the scope of the following claims.

I claim:

1. A holder platform for five gallon bucket mixing, comprising, in combination with at least one five gallon bucket and at least one mixing apparatus:

a platform having a top surface portion, a first and second opposing side surface portion to form the width of the platform:

a third and fourth opposing side surface portions to form the length of the platform; the top surface portion having at least one substantially central aperture having a predetermined depth and area for frictionally retaining said five gallon bucket for mixing;

the first, second, third and fourth side portions further comprising a respective first and second leg portion for supporting the platform according to a predetermined load capacity such that said platform resists buckling from cyclical loads; said first side surface portion is formed contiguous with a top surface portion along a first edge and a second and third edge portion of the third and fourth surface side portions; and said second side surface portion is formed contiguous with a top surface portion along a second edge and a fourth and fifth edge portion of the third and fourth surface side portions; at least one of the leg portions of the third and fourth side surface portions is made contiguous and orthogonal with at least one leg portion of the first and second side portions to form a respective single leg portion having support in two planar directions.

2. The holder platform according to claim 1, wherein said platform is made of a high strength plastic material.

3. The holder platform according to claim 2, wherein said plastic material is a composite plastic material.

4. The holder platform according to claim 1, wherein the respective leg portions of each respective side portion has a first and second diagonal edge extending from the base of the respective leg portion to a predetermined height and terminating along a respective horizontal edge portion; the height of the diagonal edge portions being determined to minimize buckling for cyclical loadings.

* * * * *